United States Patent [19]

Vail et al.

[11] Patent Number: 4,920,697

[45] Date of Patent: May 1, 1990

[54] DUAL DRIVE WINDOW REGULATOR MECHANISM

[75] Inventors: Curtis F. Vail, Ann Arbor; Robert H. Dietze, Bloomfield Hills; Thomas F. Kracht, St. Clair Shores; Joanne H. Cole, Ann Arbor; Marc D. Hewko, Dearborn, all of Mich.

[73] Assignee: Hoover Universal Inc., Ann Arbor, Mich.

[21] Appl. No.: 423,659

[22] Filed: Oct. 18, 1989

Related U.S. Application Data

[63] Continuation of Ser. No. 272,640, Nov. 17, 1988, abandoned.

[51] Int. Cl.[5] ..... E05F 11/38

[52] U.S. Cl. ..... 49/348; 49/349; 49/352

[58] Field of Search ..... 49/349, 352, 348, 227, 49/374, 350, 351

[56] References Cited

U.S. PATENT DOCUMENTS

| | | | |
|---|---|---|---|
| 4,001,971 | 1/1977 | Gobush et al. | 49/352 |
| 4,110,935 | 9/1978 | Sessa | 49/352 |
| 4,420,906 | 12/1983 | Pickles | 49/352 |
| 4,483,100 | 11/1984 | Blankenburg et al. | 49/352 |
| 4,642,941 | 2/1987 | Staran et al. | 49/352 |
| 4,685,248 | 8/1987 | Hammond | 49/352 |
| 4,793,099 | 12/1988 | Friese et al. | 49/352 X |

FOREIGN PATENT DOCUMENTS

| | | | |
|---|---|---|---|
| 2323784 | 11/1974 | Fed. Rep. of Germany | 49/352 |

*Primary Examiner*—Philip C. Kannan

*Attorney, Agent, or Firm*—Harness, Dickey & Pierce

[57] ABSTRACT

A dual drive window regulator mechanism is disclosed for use in an automobile door assembly for raising and lowering the window glass. The system provides two attachment points to the glass for raising and lowering the glass. This can be accomplished by using various lift mechanisms including a translating rack or a dual cable and drum mechanism. By driving the window at two points as opposed to one point in typical regulator mechanisms, more accurate control of the movement and location of the window glass in the door assembly is achievable.

5 Claims, 3 Drawing Sheets

FIG. 2
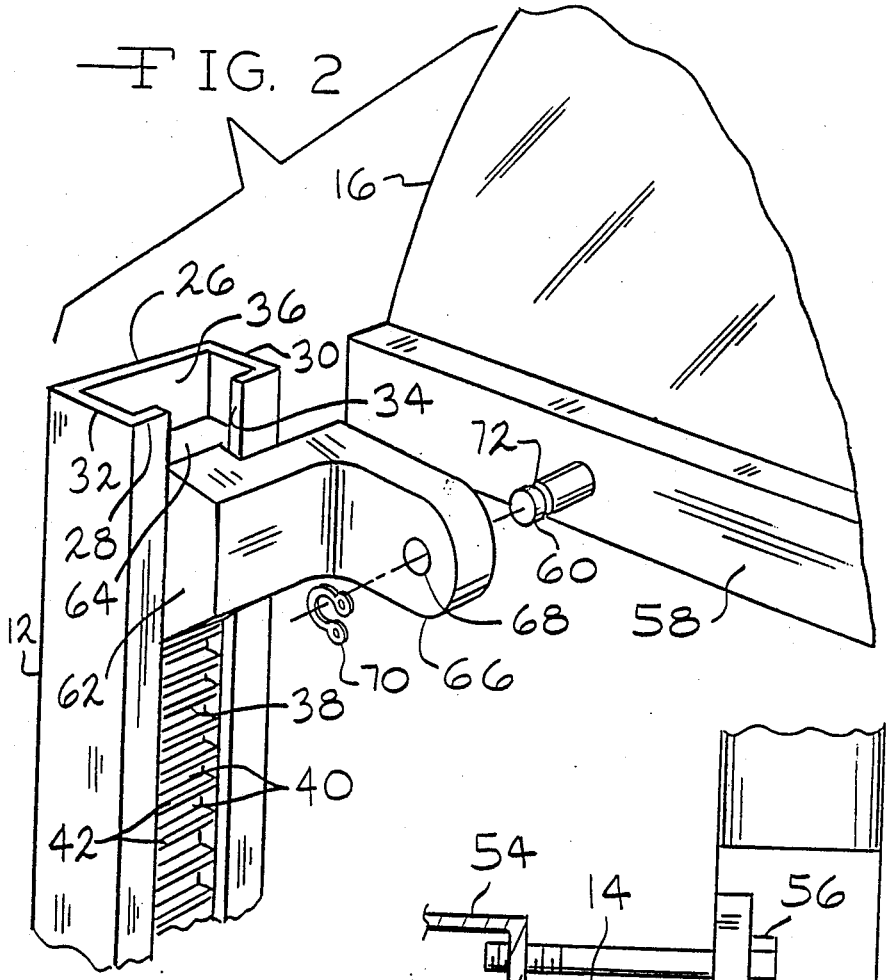
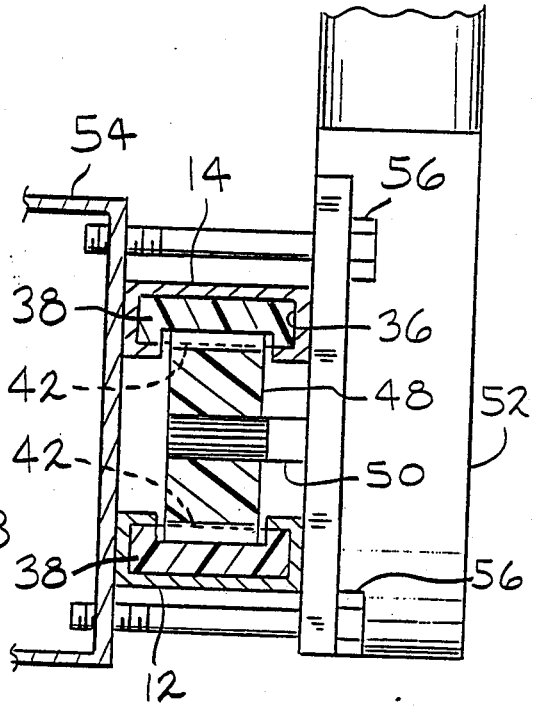
FIG. 3

DUAL DRIVE WINDOW REGULATOR MECHANISM

This is a continuation of U.S. patent application Ser. No. 272,640, filed Nov. 17, 1988 Entitled: DUAL DRIVE WINDOW REGULATOR MECHANISM, now abandoned.

BACKGROUND AND SUMMARY OF THE INVENTION

This invention relates generally to a window regulator mechanism for a motor vehicle and more particularly to a dual drive window regulator mechanism which drives the window at two points as opposed to one point used in customary window regulator systems.

Prior window regulator systems segregate the window movement and window guidance features. Typically, a generally U-shaped guide channel is provided at the forward and rearward edges of the window glass through which the glass edges slide during raising and lowering of the window glass. A single point drive system is provided which supports the window glass at one point, generally located at the center of the glass. The drive system is used to raise and lower the window glass. As a result of having separate drive and guidance systems, there is a duplication of structure resulting in increased cost and weight.

Furthermore, new aerodynamic vehicle designs are incorporating what is referred to as four-side flush glass in which the glass exterior surface, when the window is in the uppermost position, is flush with the vehicle exterior sheet metal around the entire window periphery. With four-side flush glass, precise positioning of the window is required for proper appearance and sealing of the glass in the window opening to prevent air and water leakage. A single drive window regulator system allows more fore/aft glass movement than is acceptable with four-side flush glass.

Accordingly, it is an object of this invention to provide a window regulator system which provides more uniform drive motion and positioning of the window glass and reduces the amount of fore and aft movement of the window.

It is a feature of the invention to provide a dual drive regulator system which drives the window glass at two points as opposed to one.

It is an advantage of this invention that the glass is guided along two lines of motion such that the glass regulator and the glass guide functions are incorporated into one system, thereby reducing the total number of components in the door assembly and decreasing both the cost and weight of the door assembly.

It is a further advantage that the loads required at each drive point are approximately half of those required by a single drive system resulting in improved durability of the mechanism.

It is yet another advantage of the invention to be able to positively move a complex shaped glass panel through a narrow opening in the sill at the lower edge of the window opening.

This invention provides a dual drive window regulator mechanism which drives the glass at two points, one near the forward edge of the glass and one near the rearward edge. The glass is driven by a sliding block attached to the glass which slides in a generally vertical stationary track at both the forward and rearward edges of the window. Because the sliding blocks are retained within stationary tracks, the sliding blocks provide both the guidance function as well as the drive function for the glass thereby incorporating these functions into one system.

The sliding blocks are driven within the tracks by a translating rack enclosed within each of the tracks. The translating rack and track are similar to that disclosed in U.S. Pat. No. 4,685,248, issued Aug. 11, 1987 to Hammond. The two racks are driven simultaneously by a single drive pinion engaging both of the racks.

In another embodiment, a dual drive cable and drum system can be used to move the window glass. Glass guide channels are used to guide the glass at its forward and rearward edges. A pulley is mounted to each end of each guide channel. A continuous cable is routed around the pulleys of one guide channel and wrapped around a drum. A lift plate is attached to the cable between the two pulleys. A second cable is routed around the pulleys of the other guide channel and wrapped around the drum in the opposite direction of the first cable. A second lift plate attaches this cable to the glass. When the drum is rotated, both cables and lift plates move, raising and lowering the glass. In either embodiment, the glass can be driven either by an electric motor or a manually operated crank.

A benefit of using a translating rack is that it is relatively simple to provide motor stops by use of proximity switches attached to the translating rack to signal the ends of motor travel. This can result in improved durability of the mechanism and the seals into which the moving glass is driven in the raised position.

Further objects, features and advantages of the invention will become apparent from a consideration of the following description and the appended claims when taken in connection with the accompanying drawings.

BRIEF DESCRIPTION OF THE DRAWINGS

FIG. 2 is an enlarged exploded perspective view of a portion of the window regulator shown in FIG. 1;

FIG. 3 is an enlarged sectional view of a portion of the window regulator as seen from substantially the line 3—3 of FIG. 1, showing the regulator in an assembled position.

DESCRIPTION OF THE PREFERRED EMBODIMENT

Figure 1:
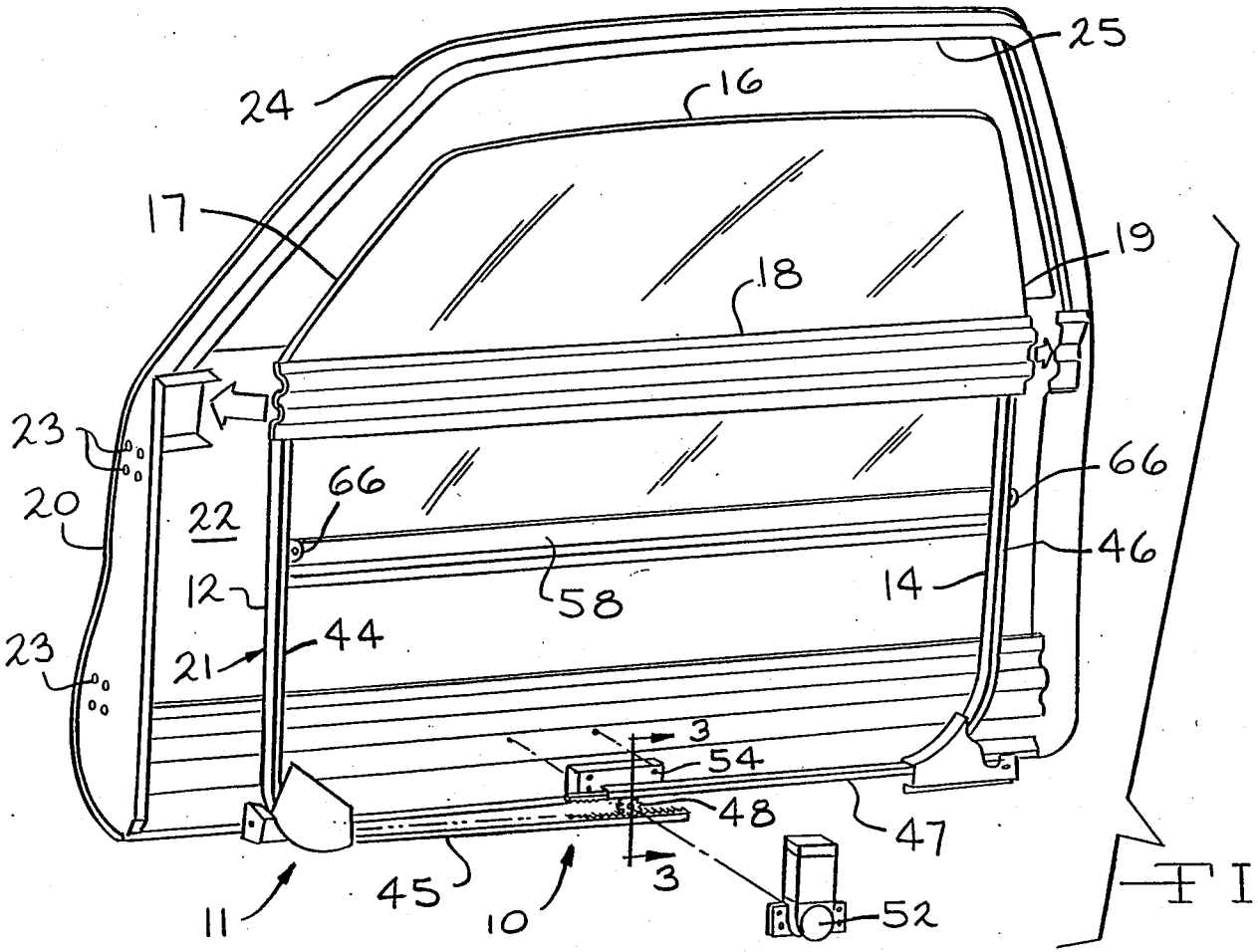
FIG. 1 is a partially exploded perspective view of a vehicle door assembly having a dual drive window regulator of this invention.

With reference to the drawing, the dual drive window regulator mechanism of this invention, indicated generally at 10, is shown in FIG. 1 in assembly relation with a vehicle door assembly 11, illustrated as the interior side of a passenger side vehicle door. The mechanism 10 includes a forward track 12 and a rearward track 14 which are used to support and guide the window glass 16. Forward track 12 is positioned at or near the forward generally vertical edge 17 of glass 16 as viewed relative to the motor vehicle into which the door assembly 11 is installed. The door assembly is mounted to a motor vehicle by hinges (not shown) attached to the door assembly at bolt holes 23. Rearward track 14 is positioned at or near the rearward generally vertical edge 19 of the glass 16.

The tracks 12 and 14, along with the window 16 and a cross member 18, are part of a functional door cartridge 21 which is installed into an outer door skin 20 to complete a vehicle door assembly. Door skin 20 includes a sheet metal panel 22, the exterior of which forms the exterior surface of the vehicle door. The door skin 20 also includes an upper window frame 24 which defines a window opening 25. The window opening is closed by the glass 16 when the glass is raised to its uppermost position in the window opening. It is to be understood that the dual drive window regulator of this invention is not limited to a door assembly employing a functional door cartridge but can also be used in a conventional door assembly.

The tracks 12 and 14, as shown in FIGS. 2 and 3, are formed from a generally rectangular channel having four side walls, namely, two long side walls 26 and 28 and two shorter side walls 30 and 32. The side wall 28 is formed with a continuous slot 34 for a purpose to appear presently. The inside surface 36 of the tracks 12 and 14 is also of generally rectangular shape. Side wall 26 can be provided with mounting flanges (not shown) which can take various forms and locations and which facilitate mounting of the tracks in the vehicle door assembly. The cross sectional shape of tracks 12 and 14 need not be rectangular as shown in the figures. Tracks having other shapes can be used, for example a D-shaped track having a slot in the flat side wall similar to slot 34 can be used. The only requirement for the shape of the track is that it be able to confine a slidable member in the track and that it have one side wall which is able to accommodate a continuous slot.

A continuous rack member 38, preferably formed of a suitable flexible plastic material which can be economically manufactured, is mounted in the tracks 12 and 14. As shown in FIG. 3, the rack 38 is of a generally rectangular shape in cross section corresponding to the rectangular shape of the inner surface 36 of the tracks 12 and 14. The rack 38 is formed with transverse evenly spaced grooves 40 which cooperate to form outwardly extending teeth 42 that are located facing the continuous slot 34.

Referring again to FIG. 1, the track 12 includes a vertical portion 44 and horizontal portion 45. Track 12 curves at the lower edge of the door assembly to form the horizontal portion 45 extending rearward from the vertical portion 44. Similarly, the rearward track 14 includes vertical portion 46 which curves at the lower edge of the door assembly to a horizontal portion 47 extending forward from vertical portion 46. The slots 34 in the tracks 12 and 14 are both oriented such that they are facing rearward relative to the vehicle in the vertical portions 44 and 46 of the tracks. The horizontal portion 47 of track 14 overlays the horizontal portion 45 of track 12. By positioning the slots 34 rearward as described above, the slots 34 are facing one another in the horizontal portions 45 and 47.

A drive pinion 48, shown in FIGS. 1 and 3, is positioned between the horizontal portions of the two tracks 12 and 14 and engages the teeth 42 of the racks 38 within tracks 12 and 14. The drive pinion 48 is driven by an output shaft 50 of an electric motor 52. Electric motor 52 is bolted to a mounting bracket 54 by bolts 56.

Referring now to FIG. 2, the glass is attached to the racks 38 of the window regulator with a glass attaching bracket 58 secured to the inner surface of the glass along its lower edge.

The glass attaching bracket 58 includes mounting studs 60 located at each end of the bracket 58 near the forward and rearward glass edges 17 and 19. The attaching bracket 58 is attached to the racks 38 by sliding blocks 62. Sliding blocks 62 include a portion 64 which extends into the track and corresponds in cross sectional shape to the general rectangular shape of the rack 38 so that the portion 64 can slide lengthwise of the track 12, engaging the inner surface 36 thereof. Sliding block 62 is attached to the end of the rack 38 and/or has teeth extending into the grooves 40 of the rack and engaging with the teeth 42 so that the sliding block 62 will slide in the track as the rack 38 is moved. Sliding block 62 also includes a mounting flange 66 having an attachment opening 68 therethrough. The mounting stud 60 is inserted through the attachment opening 68 and held in place by a C-clip 70 retained in a groove 72 in mounting stud 60. Other similar means can be used to attach the glass to the racks 38.

Once attached to the sliding block, the window 16 is held into position within the door assembly and cannot move fore and aft or side to side relative to the door assembly. This is accomplished by firmly attaching the glass to the sliding block which in turn is held in position within the tracks 12 and 14. As a result, the U-shaped glass guide channels previously used at the forward and rearward edges of the glass of the window to hold the window in position, along with a separate window regulator, are no longer needed. The effect of the invention is to combine the regulator functions and the guidance functions such that the overall number of components in the door assembly is reduced. In addition, by driving the window at two points as opposed to one point, accuracy in positioning the glass is improved.

It is also to be understood that a manually operated window crank (not shown) can also be used to raise and lower the glass 16. This can be accomplished by extending the horizontal portion 47 of track 14 to a location forward of the drive pinion 48 and adding a hand crank mechanism to the door assembly to drive the rack 38 within track 14. Pinion gear 48 is then used to transfer motion from the rack in track 14 to the rack in track 12.

Figure 4:
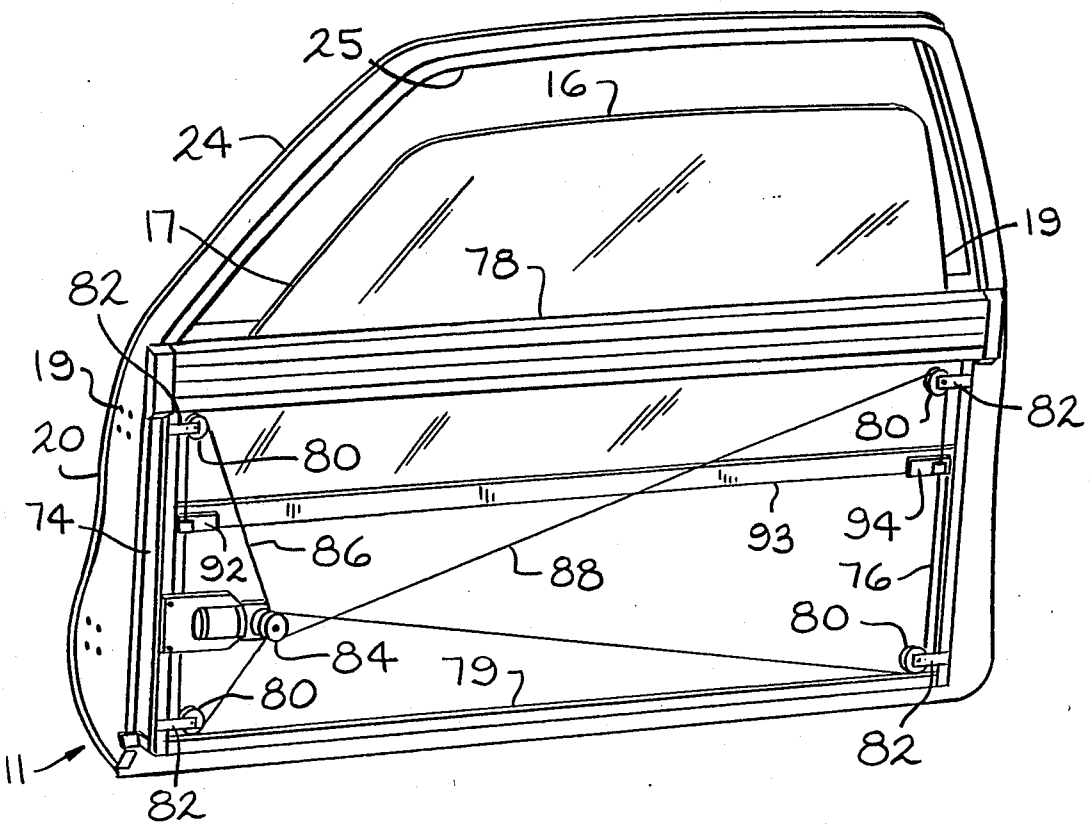
FIG. 4 is a perspective view of a vehicle door assembly similar to FIG. 1 showing another embodiment of a dual drive window regulator.

A dual cable and drum drive system can also be used to provide a dual drive window regulator as shown in FIG. 4. Two U-shaped glass guide channels, a forward channel 74 and a rearward channel 76, are used to guide the motion of the glass 16. Guide channels 74 and 76 face one another with the glass moving within the channels. These guide channels can be either part of a functional door cartridge used in a vehicle door assembly or they can be separately installed in the door 11 in a conventional manner. As shown in FIG. 4, cross members 78 and 79 are used to rigidly support the guide channels 74 and 76. Four pulleys 80 are attached to the guide channels 74 and 76 adjacent their top and bottom ends. The pulleys 80 are attached to the exterior of the channels by brackets 82.

A drum assembly 84 is included in the door assembly and has two cables 86 and 88 partially wrapped around the drum. Cable 86 is routed around the upper pulley 80 on guide channel 74, down along the side of channel 74, around the lower pulley on the guide channel 74 and around the drum 84 at least one complete revolution. Likewise, the cable 88 is routed around the upper and lower pulleys of guide channel 76 and around drum 84 more than one revolution. Cable 88 is wrapped in the opposite direction around the drum 84 from cable 86.

In operation, as the drum is rotated in a counterclockwise direction as shown in FIG. 4, the cable 88 is drawn from the lower pulley 80 to the drum 84, and cable 88 is simultaneously unwound from the drum 84 toward the upper pulley 80. Likewise the cable 86, as the drum is rotated counterclockwise, is drawn from the lower pulley and wrapped around the drum and is simultaneously unwound toward the upper pulley. As drum 84 is rotated clockwise, the movement of the cables 86 and 88 is in the opposite direction.

A lift plate 92 is attached to the cable 86 between the two pulleys mounted on guide channel 74. Lift plate 92 is also attached to a glass attaching bracket 93 extending along the bottom edge of the glass 16. Likewise a second lift plate 94 is attached to the cable 88 between the two pulleys mounted on the guide channel 76. Lift plate 94 is also attached to the glass attaching bracket 93. As the drum 84 is rotated thus moving the cables, the lift plates also move, thereby raising and lowering the glass 16. The lift plate 92 is thus attached to the glass 16 at a point adjacent to the forward edge 17 of the glass and the lift plate 94 is attached to the glass 16 at a point adjacent to the rearward edge 19 of the glass 16.

A dual cable and drum lift regulator mechanism is thus provided which includes two lift points for the window glass 16. One lift point at or near the forward edge 17 of the glass and a second lift point at or near the rearward edge 19 of the glass. As with the translating rack embodiment described above in conjunction with FIGS. 1–3, the dual cable and drum regulator system provides the advantages of guiding the glass more accurately. Additionally, by attaching the pulleys to the guide channels 74 and 76, a separate cable and pulley guide in the center of the door, as used in a single drive cable and drum regulator, is no longer required, thereby reducing the number of components necessary for the system. The drum 84 can be rotated with a manual window crank or by use of an electric motor.

It is to be understood that the invention is not limited to the exact construction or method illustrated and described above, but that various changes and modification may be made without departing from the spirit and scope of the invention as defined in the following claims.

What is claimed is:

1. In a vehicle door assembly having a generally vertical window opening and a storage cavity beneath the window opening, a generally vertical window glass having fore and aft upright edges and a generally horizontal lower edge, said glass being movable between a raised position closing the opening and a lowered position stored in the storage cavity, the improvement comprising a window regulator mechanism operable to drive the glass along a path extending between said raised and lowered positions and operable to guide said window glass within said path, said regulator mechanism being coupled to said glass at two spaced locations adjacent the lower glass edge for driving and guiding said glass, said regulator mechanism including:

a pair of elongated hollow tracks in said cavity, at least a portion of each track being upright, said tracks having side walls and one side wall of each track having a continuous slot extending lengthwise of said tracks, each of said tracks terminating in upper ends at the top of said upright portions, said upper ends being disposed adjacent the top of said storage cavity;

a pair of flexible and elongated sliding members, one of said pair of sliding members disposed within one of said tracks and the other of said pair of sliding members disposed within the other track, said sliding members being confined within said tracks so that movement of said sliding members relative to said tracks is limited to sliding movement lengthwise in said tracks, said sliding members including means for engaging said members to drive said members within said tracks, said engaging means being accessible through the slot in said tracks;

means for attaching said sliding members to said glass at two separate point locations adjacent said lower glass edge for moving and guiding said glass along said path in response to movement of said sliding members within said tracks, said glass attaching means being firmly attached to said glass to provide the guidance for said glass along said path whereby said glass is driven and guided at said two point locations; and drive means extending through said slots in both of said tracks and operatively associated with said engaging means of said sliding members for simultaneously moving said sliding members within said tracks to effect movement of said glass along said path between said raised and lowered positions.

2. The window regulator mechanism of claim 1 wherein said sliding members are attached to said glass adjacent said fore and aft edges.

3. The window regulator mechanism of claim 1 wherein said engaging means is a plurality of transverse teeth disposed upon said sliding members accessible through said slots.

4. The window regulator mechanism of claim 3 wherein said drive means includes a pinion gear extending through the slots of both said tracks and engaging the teeth of said sliding members to effect movement of said sliding members.

5. The window regulator mechanism of claim 4 wherein said pinion gear is positioned in the center of the door assembly adjacent the lower edge of said storage cavity.

* * * * *